US008627625B2

(12) United States Patent
Bouchard et al.

(10) Patent No.: US 8,627,625 B2
(45) Date of Patent: Jan. 14, 2014

(54) MASONRY WALL PANEL FOR RETAINING BRICKS

(75) Inventors: Michel Bouchard, Rivieres-des-Prairies (CA); John Penterman, Notre-Dame-du-Nord (CA)

(73) Assignee: Oldcastle Building Products Canada Inc. (CA)

( * ) Notice: Subject to any disclaimer, the term of this patent is extended or adjusted under 35 U.S.C. 154(b) by 0 days.

(21) Appl. No.: 13/146,929

(22) PCT Filed: Jan. 29, 2010

(86) PCT No.: PCT/CA2010/000133

§ 371 (c)(1),
(2), (4) Date: Dec. 20, 2011

(87) PCT Pub. No.: WO2010/085894

PCT Pub. Date: Aug. 5, 2010

(65) Prior Publication Data

US 2012/0085052 A1 Apr. 12, 2012

Related U.S. Application Data

(60) Provisional application No. 61/222,980, filed on Jul. 3, 2009.

(30) Foreign Application Priority Data

Jan. 30, 2009 (WO) ..... PCT/CA2009/000118

(51) Int. Cl.
*E04F 13/08* (2006.01)

(52) U.S. Cl.
USPC ..... 52/387; 52/506.06

(58) Field of Classification Search
USPC ..... 52/384, 386, 387, 389, 314, 510, 555, 52/444, 445, 453, 506.06, 506.08
See application file for complete search history.

(56) References Cited

U.S. PATENT DOCUMENTS 658,868 A 10/1900 Rosenbaum
1,673,630 A 6/1928 Madge (Continued)

FOREIGN PATENT DOCUMENTS

CA 2211511 2/1988
CA 2387181 11/2003

(Continued)

OTHER PUBLICATIONS

International Search Report dated Nov. 29, 2010 in related International Application No. PCT/CA2010/001191.

(Continued)

*Primary Examiner* — Jessica Laux
(74) *Attorney, Agent, or Firm* — Kilpatrick Townsend & Stockton LLP

(57) ABSTRACT

The present invention concerns a masonry wall panel assembly comprising a panel and a plurality of bricks. The panel is provided with a plurality of horizontally extending contiguous channels bounded by upper and lower protruding ribs, for fitting a row of bricks. Each channel is also fitted with a plurality of compressible retaining tabs positioned along the upper rib of each channel for retaining bricks inserted therein. The bricks are provided with at least one cavity and at least one compression area so that when a brick is inserted into a channel of the panel, the brick is positioned between the ribs such that the cavity of the brick faces one or more of the tabs located on the channel so that the tabs protrude into the cavity of the brick while at the same time compressing the compression area, thereby retaining the brick within the channel.

19 Claims, 11 Drawing Sheets

(56) References Cited

U.S. PATENT DOCUMENTS

| | | | | | |
|---|---|---|---|---|---|
| 1,704,035 | A | | 3/1929 | Cochran | |
| 1,707,347 | A | | 4/1929 | Dunbar | |
| 1,806,113 | A | | 5/1931 | Nygaard | |
| 1,861,359 | A | | 5/1932 | Pyron | |
| 2,043,706 | A | | 6/1936 | Myers | |
| 2,135,118 | A | | 11/1938 | Stewart | |
| 2,198,466 | A | | 4/1940 | Stolze | |
| 2,832,102 | A | | 4/1958 | Amoruso | |
| 2,882,713 | A | | 4/1959 | Diehl | |
| 2,938,376 | A | | 5/1960 | Workman et al. | |
| 3,005,293 | A | | 10/1961 | Hunter | |
| 3,321,883 | A | | 5/1967 | Pascucci | |
| 3,421,278 | A | | 1/1969 | Christ-Janer | |
| 3,496,694 | A | | 2/1970 | Hicks et al. | |
| 3,712,825 | A | | 1/1973 | Yocum | |
| 3,908,326 | A | | 9/1975 | Francis | |
| 4,011,702 | A | | 3/1977 | Matyas | |
| 4,238,915 | A | | 12/1980 | Yoshida et al. | |
| 4,242,299 | A | * | 12/1980 | Adams | 264/504 |
| 4,478,021 | A | * | 10/1984 | Person | 52/375 |
| 4,589,241 | A | | 5/1986 | Volpenhein | |
| 4,773,201 | A | | 9/1988 | Trezza | |
| 4,809,470 | A | | 3/1989 | Bauer et al. | |
| 4,856,246 | A | | 8/1989 | Shimasaki | |
| 4,890,433 | A | | 1/1990 | Funaka | |
| 4,916,875 | A | | 4/1990 | Kashiwagi | |
| 4,987,712 | A | | 1/1991 | Mancuso | |
| 5,228,937 | A | | 7/1993 | Passeno | |
| 5,423,155 | A | | 6/1995 | Bauer | |
| 5,501,049 | A | | 3/1996 | Francis et al. | |
| 5,815,986 | A | | 10/1998 | Laska | |
| 5,815,989 | A | * | 10/1998 | Bennenk et al. | 52/80.1 |
| 5,822,937 | A | | 10/1998 | Mahony et al. | |
| 5,855,075 | A | | 1/1999 | DiGiovanni | |
| 5,894,676 | A | | 4/1999 | DiGiovanni | |
| 6,098,363 | A | | 8/2000 | Yaguchi | |
| 6,164,037 | A | | 12/2000 | Passeno | |
| 6,857,248 | B2 | | 2/2005 | Ouellet et al. | |
| 6,990,778 | B2 | | 1/2006 | Passeno | |
| 7,121,051 | B2 | | 10/2006 | Hunsaker | |
| D539,927 | S | | 4/2007 | Whitson | |
| D578,224 | S | | 10/2008 | Lacas | |
| D579,576 | S | | 10/2008 | Lacas | |
| D584,834 | S | | 1/2009 | Lacas | |
| 7,658,050 | B2 | | 2/2010 | Bouchard | |
| D615,216 | S | | 5/2010 | Jacot et al. | |
| D633,630 | S | | 3/2011 | Jacot et al. | |
| 8,101,113 | B2 | | 1/2012 | Castonguay et al. | |
| D659,263 | S | | 5/2012 | Jacot et al. | |
| 2004/0050003 | A1 | | 3/2004 | Passeno | |
| 2004/0065035 | A1 | * | 4/2004 | De Vlam | 52/384 |
| 2005/0028476 | A1 | * | 2/2005 | Bouchard et al. | 52/596 |
| 2005/0284063 | A1 | | 12/2005 | Losse | |
| 2006/0249881 | A1 | | 11/2006 | Castonguay et al. | |
| 2007/0193176 | A1 | * | 8/2007 | Bouchard et al. | 52/506.06 |
| 2010/0326010 | A1 | * | 12/2010 | Bouchard | 52/762 |
| 2012/0117904 | A1 | | 5/2012 | Bouchard et al. | |

FOREIGN PATENT DOCUMENTS

| | | |
|---|---|---|
| EP | 0390547 | 10/1990 |
| GB | 2245619 | 1/1992 |
| GB | 2371314 | 7/2002 |
| JP | 2001132194 | 5/2001 |
| WO | WO-9305251 | 3/1993 |
| WO | WO-9922091 | 5/1999 |
| WO | WO-2009094778 | 8/2009 |
| WO | WO-2010085894 | 8/2010 |
| WO | WO-2011011891 | 2/2011 |

OTHER PUBLICATIONS

Non Final Office Action in Related U.S. Appl. No. 12/865,180 dated Mar. 29, 2012.

International Search Report dated May 12, 2009 in related International Application No. PCT/CA2009/000118.

International Preliminary Report on Patentability dated Aug. 3, 2010 in related International Application No. PCT/CA2009/000118.

International Preliminary Report on Patentability dated Jan. 3, 2012 in related International Application No. PCT/CA2010/001191.

International Search Report dated Apr. 26, 2010 in related International Application No. PCT/CA2010/000133.

International Preliminary Report on on Patentability dated Aug. 2, 2011 in related International Application No. PCT/CA2010/000133.

Response in Related U.S. Appl. No. 12/865,180 dated Aug. 16, 2012, 17 pages.

Final Office Action in Related U.S. Appl. No. 12/865,180 dated Jan. 18, 2013, 19 pages.

Response in Related U.S. Appl. No. 12/865,180 dated Apr. 18, 2013, 28 pages.

Notice of Allowance in Related U.S. Appl. No. 12/865,180 dated Aug. 16, 2013, 11 pages.

Restriction Requirement in related U.S. Appl. No. 13/387,350 dated Oct. 3, 2013, 7 pages.

Response to Restriction Requirement in related U.S. Appl. No. 13/387,350 dated Dec. 2, 2013, 3 pages.

* cited by examiner

MASONRY WALL PANEL FOR RETAINING BRICKS

CROSS REFERENCE TO RELATED APPLICATIONS

This application is the U.S. national phase of International Application No. PCT/CA2010/000133 filed on Jan. 29, 2010 and published in English on Aug. 5, 2010 as International Publication No. WO 2010/085894 A1, which application claims priority to U.S. Provisional Application No. 61/222,980 filed on Jul. 3, 2009 and also claims priority to International Application No. PCT/CA2009/000118 filed on Jan. 30, 2009, the contents of all of which are incorporated herein by reference.

FIELD OF THE INVENTION

The present invention relates to the field of masonry works and installations. More particularly, it concerns panels having horizontal channels adapted to receive bricks so as to form a masonry wall.

BACKGROUND

Stone masonry and brick masonry facings have been traditionally constructed by skilled workers from individual units, such as bricks, stones, or rocks, set and mortared one after the other into the shape of a wall. This is a very long process which is time consuming.

Different solutions have been proposed in the prior art for reducing the time required for forming or designing a masonry wall, such as a brick work, or for making its construction available to an unskilled person.

Among these prior art solutions, there are the prefabricated artificial facings which consist of panels or form liners with an assemblage of decorative prefabricated moulded bricks or stones giving the appearance of natural brick, stone or other masonry material. These pre-fabricated panels or liners often do not provide an architecturally satisfactory appearance of real brick or stone. Also, they are often very heavy and are thus difficult and cumbersome to transport to the job site and to install on the building structure. Another drawback with many of these pre-fabricated panels is that once installed side by side on a surface, the separation line between the panels is clearly visible which makes those prefabricated panels less attractive for someone researching the appearance of a real natural stonework. Examples of such prior art prefabricated facings are giving in U.S. Pat. Nos. 2,339,489; 3,496,694; 3,350,827; 3,712,825; 3,908,326; 4,510,729; 4,656,722; 5,386,963; 5,632,922; 6,041,567; and 6,164,037.

Also known in the prior art, there are U.S. Pat. Nos. 5,855,075 and 5,894,676, which disclose a brick template for laying a plurality of bricks. This template, which serves as a guide for mounting the rows of bricks, includes a planar and rigid sheet having a plurality of support pins projecting therefrom in a predetermined pattern for supporting a plurality of bricks.

Further known in the prior art, there is U.S. Pat. No. 5,009,387 which discloses a liner made of an elastomeric material with recesses formed therein for receiving bricks. Retaining devices attached to the liner are provided for retaining the pieces of brick into the recesses.

U.S. Pat. No. 5,839,251 discloses a masonry construction aid which allows its user to insert masonry into a pre-determined, pre-formed, soluble pattern that contains within a bonding material. After applying a catalyst to the pattern, the pattern disintegrates, the bonding agent activates and bonds the masonry together and hardens into a permanent structure. The pattern disclosed therein is devised to form a non complex masonry work with respect to the arrangement of the bricks on the wall.

U.S. Pat. No. 5,501,049 discloses a thin brick panel assembly for forming a brick facing on a building structure. The brick panel assembly includes a backing member with a generally uniform cross-section throughout its entire length, providing channels, which allow the thin brick tiles to lay uniformly across each row. The channels are defined by retaining bars which hold the thin brick tiles in place. The retaining bars include mortar lock notches, which are adapted to provide a dovetail connection between the mortar and the backing board, and a path for moisture and water to escape from the brick panel assembly.

Also known in the prior art, there is the panel system disclosed in the CA 2,485,870 in the name of the Applicant which discloses an artificial masonry unit suitable for use with a panel made of a compressible material having masonry unit receiving depressions in a front face thereof and protruding ribs defining and bordering the depressions. The depressions are sized to receive respective artificial masonry units in a close-fitting relationship. The artificial masonry unit comprises a body bounded by a front face, a back face, and a lateral face providing a thickness to the unit, and a back peripheral edge joining the back face and the lateral face. A tooth projection is projecting from the lateral face next to and parallel to the back peripheral edge for thrusting into the protruding rib when the masonry unit is inserted in a respective depression. The tooth projection is thrusting into the rib of a respective depression and helps retain the masonry unit within the depression prior to mortaring the wall. As can be appreciated, this system requires the use of customized masonry units provided with one or more tooth projections. A conventional standard brick available on the market would not be suitable with this system.

Further known in the prior art, U.S. Pat. No. 5,860,261 discloses an apparatus for retaining bricks to a wall structure, without the use of mortar or other binding agents. The disclosed apparatus is also able to be used as a brick laying guide for the construction of a conventional brick and mortar wall. The apparatus includes a base plate which is fixed to a base structure. Two retainer arms extend perpendicularly outward from the base plate and are attached thereto, thus forming a retaining space in between the inner faces of the two opposing arms. Each of the arms have at least one prong that extend into the retaining space. A brick equipped with vertical holes that extend the length if its body allows for the prongs to extend into the holes of the brick when inserted into the retaining space. In other words, once a brick is inserted into a retaining space at a sufficient enough depth, the prongs that extend into the holes hold the brick securely in place at the desired distance from the wall structure.

As well, U.S. Pat. No. 5,634,305 discloses a stone cladding system having a plurality of facing blocks which are arranged into superposed courses. A first block placed into a first course has a first step which defines a lower tread, with a riser, and a top thread which extends along the top surface of the inserted block. A second block inserted into a second course, disposed above the before mentioned first course, is provided with a second step being complementary to the first one which extends along the length of the bottom surface of the block and engages with the first step of the block inserted into the first course. The system is also provided with a plurality of vertically spaced horizontally-extending rails which are attached to the wall to be faced. The rails support the facing blocks by overriding the top tread and riser of blocks placed in the first course and by underlying the bottom surface of blocks placed in the second course.

Also known in the art is the Structural Support Panel System for Brick, Tile or Stone, or the "TABS(tm) II Wall product" manufactured by Tabs Wall System LLC. The disclosed system includes a support panel with an integrated tab & locking system. Integrated support tabs are sized for veneer thickness and adjustable ties are provided for veneer dimensions.

The following prior art documents provide other examples of wall construction using panels and/or masonry units: U.S. Pat. Nos. 3,496,694; 3,712,825; 3,908,326; 4,589,241; 5,228,937; 5,501,049; 5,894,676; 3,813,838; 3,340,660; 3,701,228 and 6,164,037. Also, US application 20060101784 should be mentioned as well.

As described in some of these prior art documents, another possible way of retaining masonry units between the ribs of a channel is to apply an adhesive, such as mortar, on the back face of the units prior to inserting them into the channels. While this solution can be used with conventional clay bricks, it has the disadvantage of introducing extra steps during the installation of the units, and of requiring extra curing time in order to allow the adhesive to dry.

In light of the information above, it would be desirable to have a panel suitable for making a brick masonry wall having channels adapted to receive and retain bricks which are often provided with one or more holes without requiring modifications or alterations in the shape of the brick and without resorting to the use of adhesive or mortar. Finally, it would desirable for the panel to allow for the retention of bricks manufactured with large size variations for a predetermined size of brick.

SUMMARY OF THE INVENTION

It is an object of the present invention to provide a masonry panel that satisfies at least one of the above-mentioned needs.

Therefore, in accordance with the present invention and broadly described, that object is achieved with a masonry wall panel assembly suitable for retaining bricks comprising a panel and a plurality of bricks.

The panel has a front face provided with a plurality of horizontally extending contiguous channels. Each channel is bounded by respective upper and a lower protruding rib for fitting a row of bricks in the channel. It is worth mentioning that since the channels are contiguous one another the upper rib of one channel become the lower rib of the next upper channel. A plurality of compressible retaining tabs is positioned along the upper rib of each channel for retaining bricks inserted in the channels. The tabs project from underneath the upper ribs and extend frontward. Each tab is provided by a back portion and a front portion.

The bricks are insertable within the channels of the panel. Each brick, when in place in the panel, has an upper side facing upward, an underside facing downard; a rear side facing the panel and a rear top edge intersecting the upper side and the rear side. Each brick is provided with at least one cavity on its upper side, which at least one cavity opens out onto the rear side via an opened passage extending to the rear side or is closed. Each brick is also provided with at least one compression area located on its upper side in between the at least one cavity and the rear top edge When in use, that is, when one of the brick is inserted into a channel of the panel, the brick is positioned such that at least one of the cavity on the upper side faces one or more tab on the upper rib of the channel, such that the front portion of the one or more tab protrudes into a corresponding one of said cavity while the back portion compress the compression area of the brick, thereby retaining the brick within the channel.

The depth of the channels is determined by the thickness of the ribs bounding the channels. In a preferred embodiment, the tabs extend substantially over the entire thickness of the ribs. Still preferably, the tabs have a v-shape cross-section and the ribs are provided with deformations shaped on their upper surface, opposite the tabs. Of course, other cross-sectional shapes can be considered. According to this preferred embodiment, there is a groove at the junction of the tabs and the bottom surface of the channels, the deformation and the groove advantageously increasing the flexural capacity of the tabs, and preventing them from breaking when a brick is inserted into a given channel. This preferred embodiment advantageously allows the swift and easy insertion of bricks into the panel. It also allows the insertion of such bricks having large variations in their overall dimensions.

The present invention also provides a kit for building a masonry wall panel assembly, comprising a set of panels and a set of bricks as described above.

It is understood that a brick can be provided with more than one cavity on its upper side and that a cavity can be an open cavity, or in other words, that a cavity can open on the rear side of the brick. In addition, the term "brick" refers to a masonry unit, and is not restricted to designate conventional-sized clay bricks but rather any masonry unit having the above-mentioned characteristics.

By "compression area", it is understood to mean an area which is located on the upper side of a brick and that is comprised between the cavity and the rear top edge of the brick. The "compression area" is the area that compresses the back portion of the compressible tabs of the ribs, when the brick is inserted in the panel. For bricks having a cavity opening on their rear side, the compression area expends on both sides of the cavity, near the rear side of the brick.

In accordance with yet another aspect of the present invention there is also provided a method for making a masonry wall covering a building surface, comprising the steps of:

a) mounting a plurality of panels as described above to a building surface, side by side;
b) providing a plurality of bricks as described above; and
c) inserting the bricks in the channels, comprising, for each brick, the step of positioning the brick such that each cavity on the upper side of the brick faces one or more tab on the upper rib of a channel so that the front portion of said one or more tab protrudes into its corresponding cavity while the back portion compress the compression area of the brick, thereby retaining the brick within the channel.

As well, another aspect of the present invention provides a method for installing a masonry wall panel assembly comprising:

providing a set of panels, each panel having:
- a front face having a plurality of horizontally extending contiguous channels wherein:
  - each channel is bounded by respective upper and lower protruding ribs for fitting a row of bricks in the channel,
- a plurality of compressible retaining tabs positioned along the upper rib of each channel for retaining bricks inserted in the channels wherein:
  - each tab projects from underneath the upper rib and extends frontward; and
  - each tab has a front portion and a back portion;

providing a set of bricks, each brick comprising:
- an upper side;
- an under side;

a rear side;

a rear top edge intersecting the upper side and the rear side;

at least one cavity on the upper side, wherein said at least one cavity opens out onto the rear side via an opened passage extending to the rear side or is closed;

at least one compression area located on the upper side, in between the at least one cavity and the rear top edge;

inserting the bricks into each channel of the panels, thus forming rows of masonry bricks, comprising for each bricks the steps of:

positioning the brick such that at least one of said cavity on the upper side faces one or more tabs on the upper rib of the channel and such that the front portion of said one or more tab protrudes into a corresponding one of said cavity;

pivoting a lower part of the brick toward the panel until the under side rest on the lower rib thereby causing a compression between the compression area of the brick and the back portion of said one or more tabs; and inserting mortar material in between adjacent masonry bricks to bind the bricks together.

BRIEF DESCRIPTION OF THE DRAWINGS

Other objects, advantages and features of the present invention will become more apparent upon reading the following non-restrictive description of preferred embodiments thereof, given for the purpose of exemplification only, with reference to the accompanying drawings in which:

FIG. 3A is a "high angle shot" perspective view of a portion of the panel of FIG. 2A, while

DESCRIPTION OF PREFERRED EMBODIMENTS

Figure 1A:
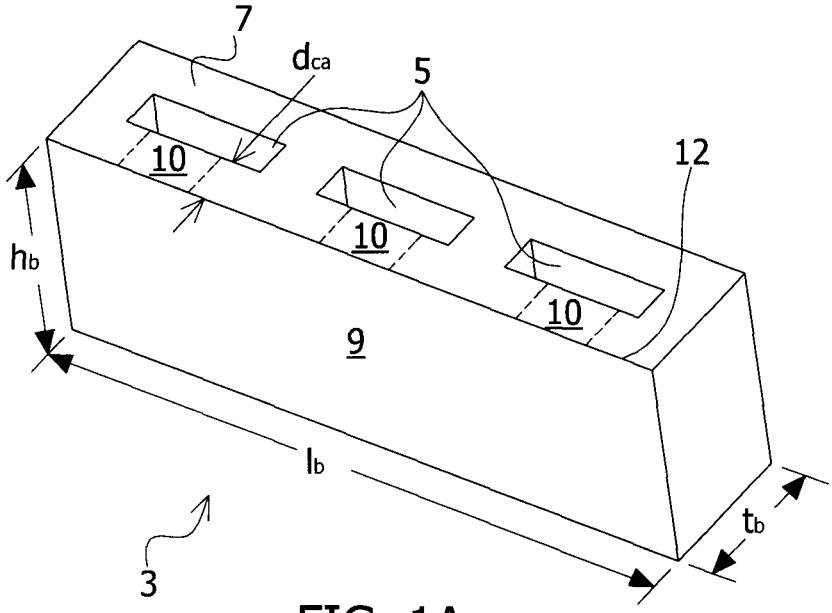
FIGS. 1A, 1B, 1C, 1D, 1E and 1F are perspective views of examples of bricks to be used in combination with a panel according to the present invention.

In the following description, similar features in the drawings have been given similar reference numerals. In order to preserve clarity, certain elements may not be identified in some figures, if they are already identified in a previous figure.

Referring to FIGS. 1A to 1F, six types of bricks 3 are shown, such as the ones that can be used in combination with a panel of the invention, described further in detail in the following paragraphs. Throughout the description, the term "brick" is not limited to designate conventional clay bricks but refers to any masonry unit made of any material, having various sizes.

The bricks 3 have an upper side 7, a rear side 9 and a rear top edge 12 intersecting the upper side and the rear side, these upper and rear sides 7, 9 being in reference to the orientation of the bricks 3 when they are inserted in a wall panel of the invention. Once inserted, the upper side 7 of a brick 3 faces upwards relative to the ground and its rear side 9 faces the panel.

Figure 1B:
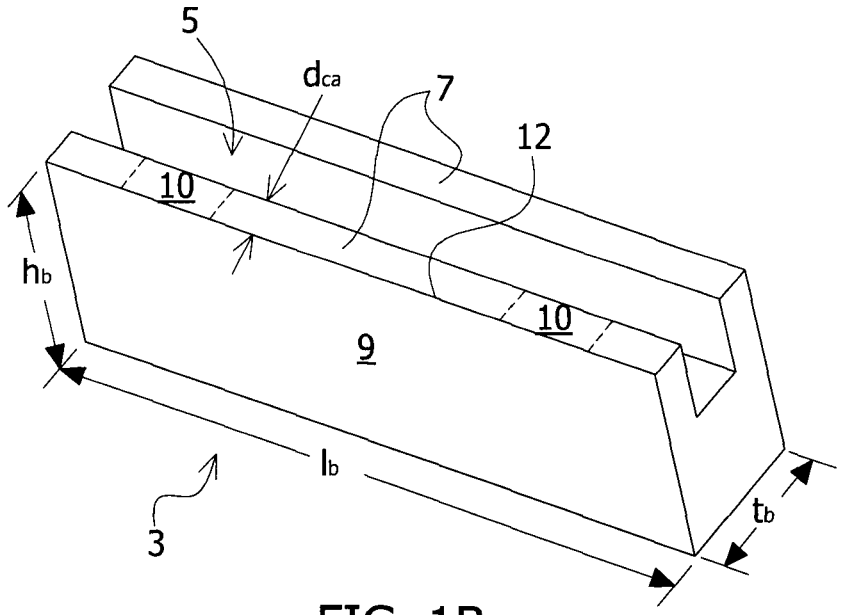
Figure 1C:
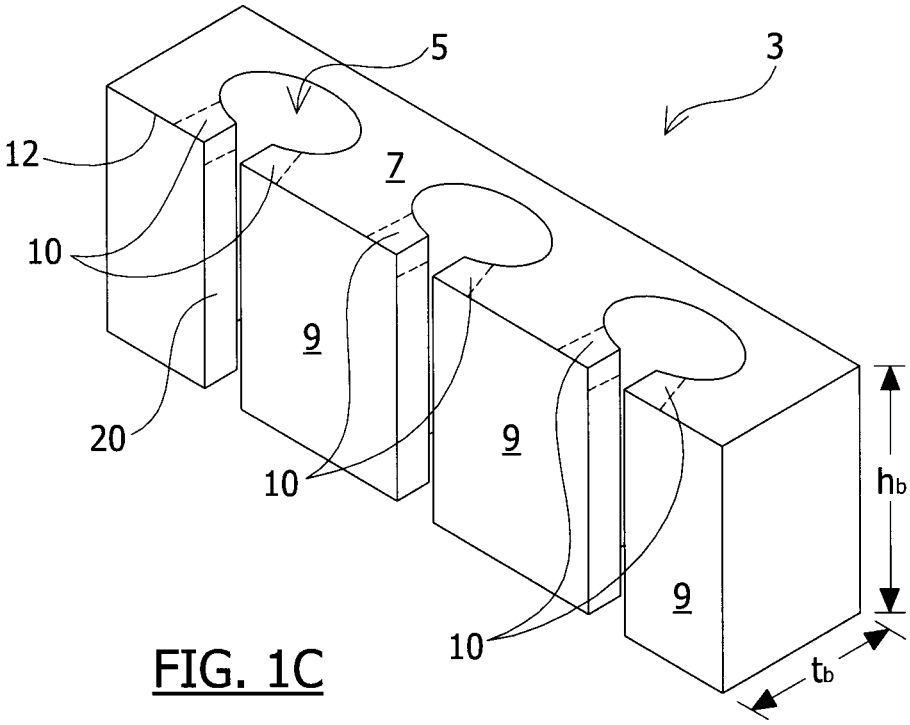
Figure 1D:
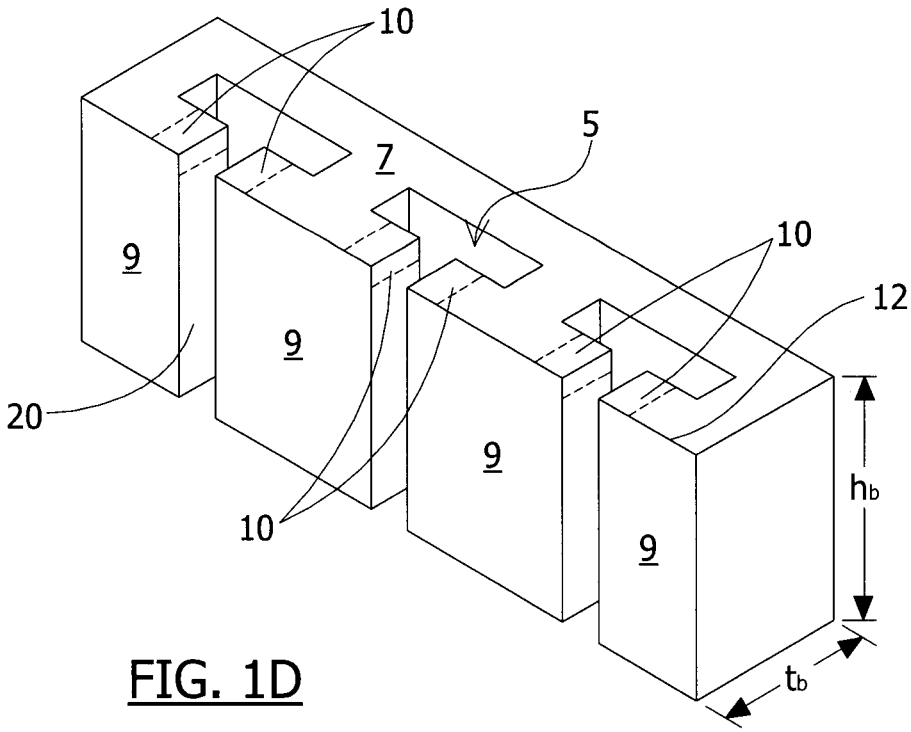
Figure 1E:
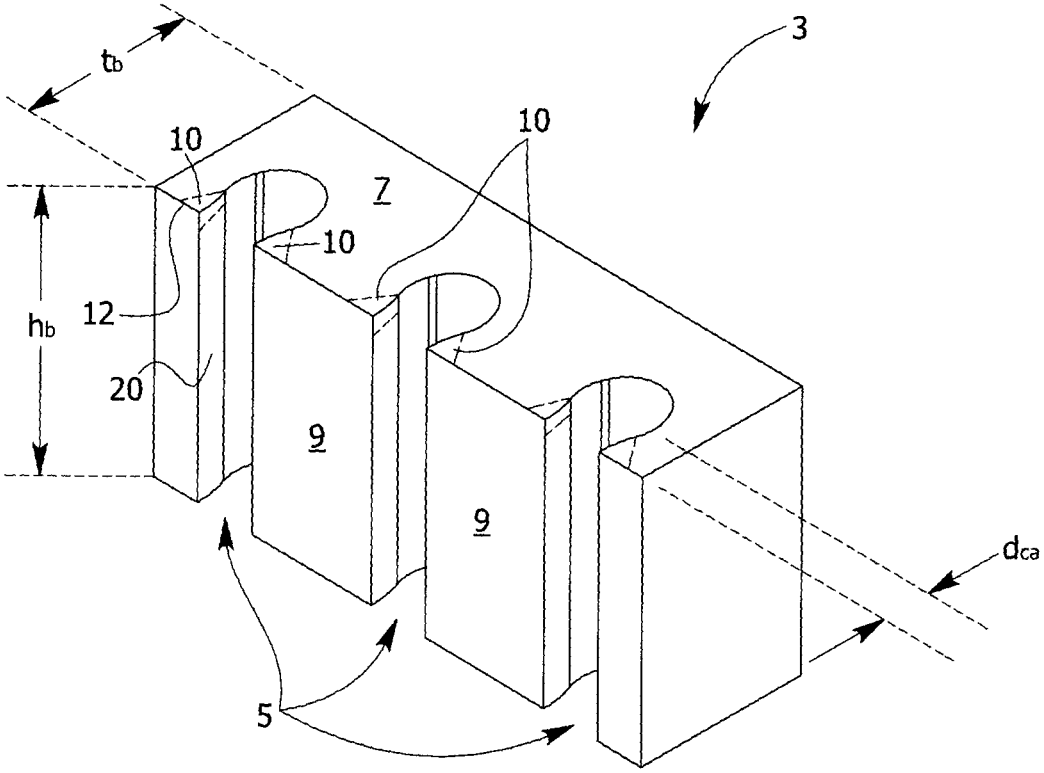
Figure 1F:
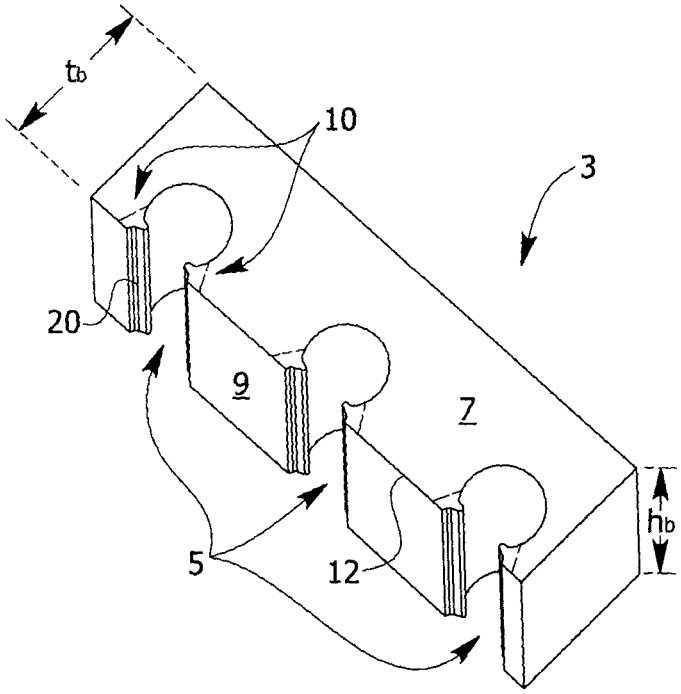

The bricks 3 are provided with at least one cavity 5 on their upper side 7. As per the different embodiments presented in FIGS. 1A to 1F, the cavity 5 can take various shapes, and is not limited to the shapes presented. The cavity 5 can be a through hole extending from the upper side 7 to an under side of a brick 3, as shown in FIG. 1A. It can be only superficial and take the shape of recess or a groove, as shown in FIG. 1B. The cavity 5 can open out onto the rear side 9 via an opened passage extending to the rear side 9, as shown in FIGS. 1C, to 1F.

Each brick 3 is also provided with a compression area 10, located on its upper side 7, in between the cavity 5 and the top rear edge 12. The function of the compression area 10 will be described later in the description.

Figure 2B:
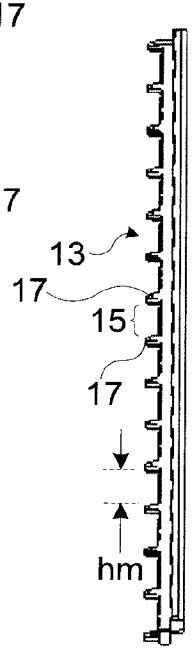
FIG. 2B is a side view of the panel of FIG. 2A.
Figure 2A:
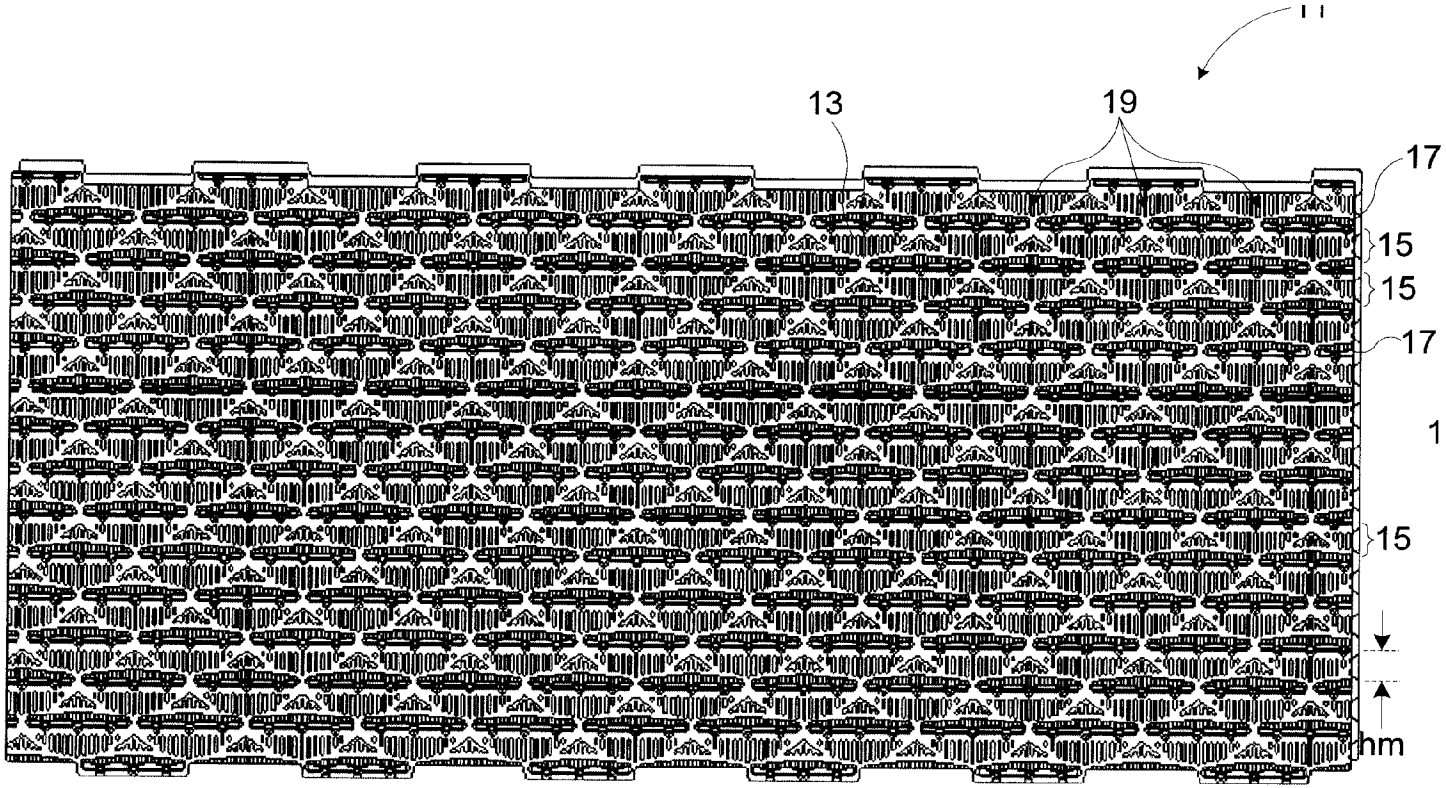
FIG. 2A is a front view of a panel, according to a preferred embodiment of the invention.

Now referring to FIGS. 2A and 2B, a panel 11 is shown according to a preferred embodiment of the invention is shown. The panel has a front face 13 provided with a plurality of horizontally extending contiguous channels 15 bounded by protruding ribs 17. The channels are designed to fit rows of masonry bricks 3 (such as the ones shown in FIGS. 1A to 1F) between the protruding ribs 17 forming the channels 15. As such, to be able to fit a brick 3 in a channel 15, the vertical distance between two neighbour ribs substantially corresponds to the height $h_b$ of the bricks 3. Preferably, the channels 15 are pre-cut in the panel 11, or pre-moulded at the same time the panel 11 is being moulded. The ribs 17 may extend continuously along the panel 11, or may be interrupted by gaps 19 thus forming aligned rib segments, as in the illustrated embodiment, for allowing better water drainage and preventing water to accumulate in a channel 15 in situations where humidity or water would come to penetrate into a channel 15. While the entire panel 11 is preferably made of a compressible material, such as EPS™ (Expanded Polystyrene), other materials (such as plastic or metal) may also be used.

Figure 3A:
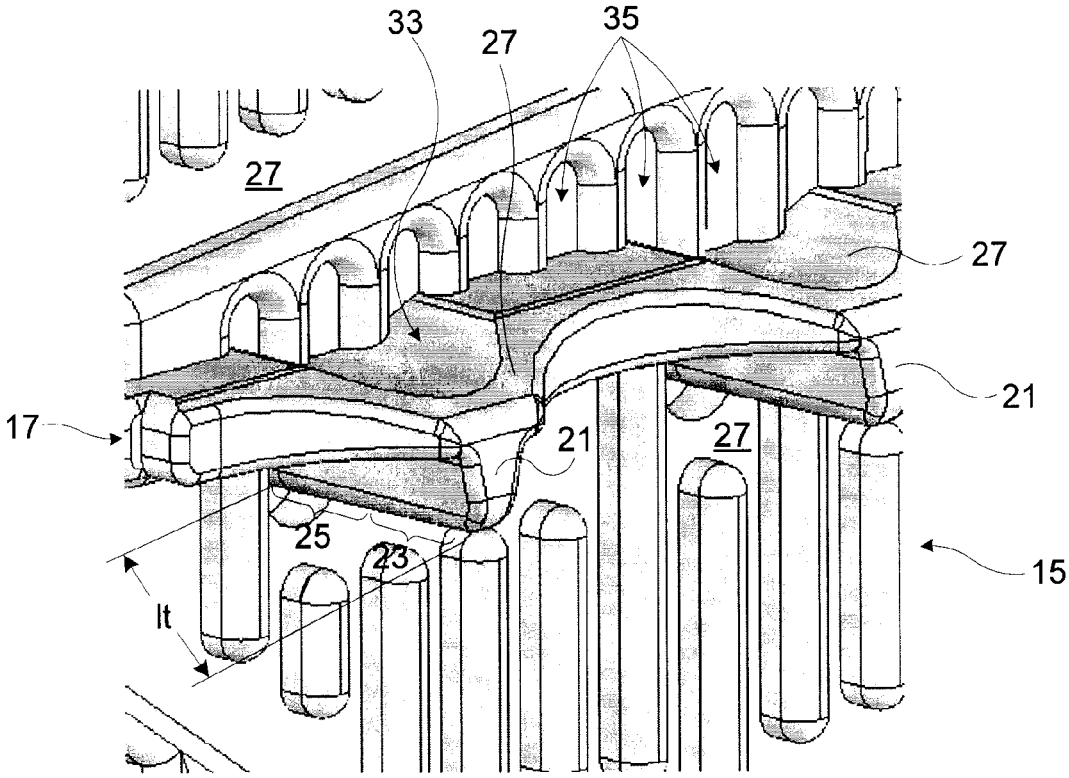
Figure 3B:
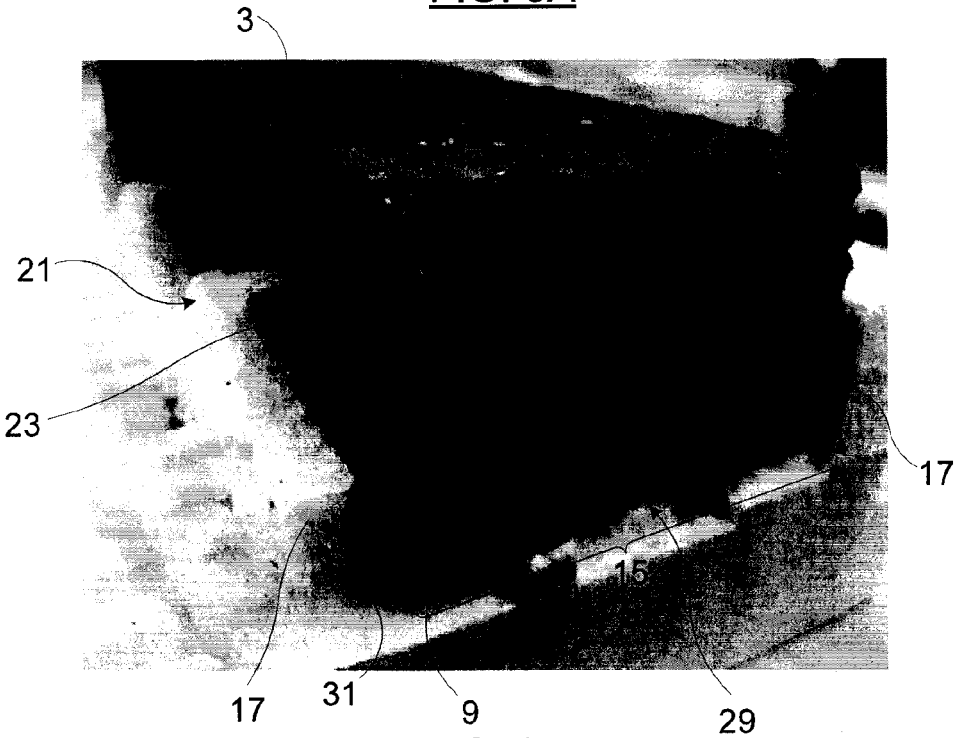
FIG. 3B is a perspective view of the same portion with a brick fitted into a channel.

As best shown in enlarged FIGS. 3A and 3B, compressible retaining tabs 21 are positioned along the ribs 17. Each tab 21 projects from underneath the rib 17 and extends frontward over a length $l_t$ that is greater than the depth $d_{ca}$ of the compression area 10 of the bricks 3 to be fitted in the channels 15. When in use, that is, when a brick is inserted in a channel 15 (as shown in FIG. 3B) the brick 3 is positioned so that the front portion 23 of the tab 21 protrudes into the cavity 5 of the brick 3. The protrusion of the front portion 23 of the tab 21 into the cavity 5 retains and secures the brick 3 within the channel 15. The length $l_t$ of the tab 21 must therefore be greater than the depth $d_{ca}$ of the compression area of the brick 3, so that at least part of the tab 21 extends and protrudes, because of its compressible nature, into the cavity 5 of the brick. The compressible nature of the tab 21 not only allows an easier passage of the brick into the channel 15 at the time of the insertion, but also allows the tab 21 to expand and protrude into the cavity 5 of the brick 3 when in place, acting as a hook to secure the brick in the channel 15.

In the preferred embodiment illustrated in FIGS. 3A and 3B, the tab 21 extends from the bottom surface 27 of the channel 15 to the front edge 29 of the protruding rib 17, in other words it extend the entire thickness of the rib 17. As such, an additional retaining effect is obtained by the compression of the back portion 25 of the tab 21, that is, by the portion 25 that is closest to the bottom surface 27 of the channel 15 over the compression area. Indeed, when a brick 3 is positioned in the channel, its cavity 5 is located in line with (or opposite to) a corresponding tab 21 of the rib 17 and the back portion 25 of the tab 21 is compressed by the compression area 10 of the upper surface of the brick 3. The combination of the downward force exerted by the compressed back portion 25 of the tab 21 over the compression area 10 of the brick 3 and of the pulling force exerted by the front portion 23 of the tab 21 protruding inside the brick cavity 5 advantageously retains the brick in place in the channel. In some embodiment of the bricks 3, such as the ones presented on FIGS. 1C to 1F, the compression area may expend on the inner lateral walls 20 of the cavities 5.

Still referring to FIG. 3A, the tabs 21 preferably have a V-shape cross-section (i.e. a tapering transverse cross-section), which increases their capacity to be deformed and compressed, a characteristic which is especially advantageous at the time of inserting bricks 3 in the channels 15 of a panel 11.

Still preferably, portions of the ribs 17 between two tabs 21 may have a depth that is shorter than the length of the tabs 21. This increases the size of the surface area of the top of the brick that is exposed during the insertion process, which will facilitate the manipulation of the brick 3 if repositioning or adjustment is required. This design also has the benefit of increasing the surface of the brick onto which mortar will eventually be applied, thereby increasing the structural integrity of the masonry wall once completed. Of course, in other embodiments, the thickness of the ribs 17 can correspond to the length $l_t$ of the tabs 21 and may even be longer that the length $l_t$ of the tabs 21, as long as the thickness of the protruding ribs 17 is shorter than the thickness $t_b$ of the bricks to be inserted in the panel 11, for obvious aesthetic reasons. As well, the thickness of the upper ribs can decrease between the tabs.

Referring to FIG. 3A, the top surface of the rib 17 opposite the tab is preferably provided with concave deformations 33, each one being opposite to one of the tabs 21 which advantageously provides more flexibility to the tab at the time of positioning the brick underneath the rib 17. Such a deformation 33 may also help to accommodate a brick 3 having protuberances located on its back edge or having dimensions slightly wider than its predetermined size, both situations being common with clay bricks.

Figure 4:
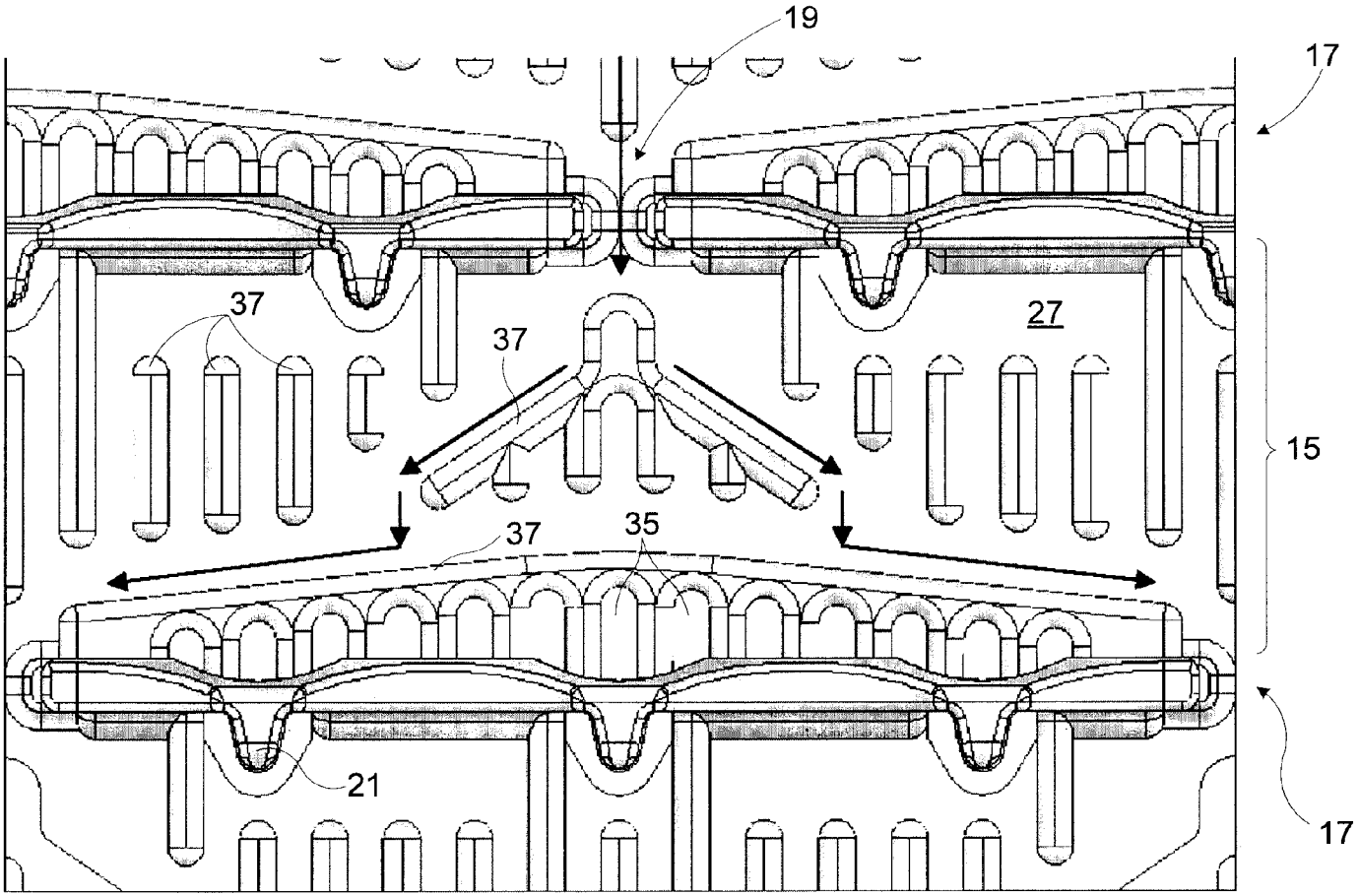
FIG. 4 is an enlarged partial front view of the panel of FIG. 2A.

Now referring to FIG. 4, the bottom surface 27 of the channels 15 can also be provided with protuberances (also referred to as drainage ribs) 37, to help drain water downward, off the panel 11. One can see from FIG. 4 that the drainage ribs 37 are for guiding water seeping through the assembly. In the illustrated embodiment, three types of protuberances or drainage ribs 37 are shown.

A first type consists of an inverted-V shaped protuberance or rib having its pointed end located opposite the gaps 19 of the protruding ribs 17.

A second type consists of vertical ribs, which are located between the inverted V-shaped ribs and within the V portion of the inverted V-shaped ribs.

Finally, a third type consists of curved or arched ribs, each extending above one rib segment 17 and under one of the inverted V-shaped rib to receive water flowing out from the inverted V-shaped rib, directing it towards the gaps bordering the ribs segment. Each arched rib is also provided with recesses 35, which can be of oblong shape such as in FIG. 3A, adjoining the rib segment located under the arched rib. The recesses 35 may also consist of elongated deformations or indentations extending continuously above the rib segments. The recesses 35 help to accommodate larger or irregular bricks 3, for example bricks having jagged edges The combined use of all these protuberances or drainage ribs 37 facilitates water drainage towards the bottom of the panel 11. Also, with respect to the vertical ribs, they are provided with a predetermined width and spacing between each two adjacent vertical ribs so as to guide the installation of the bricks within the channels.

Figure 5:
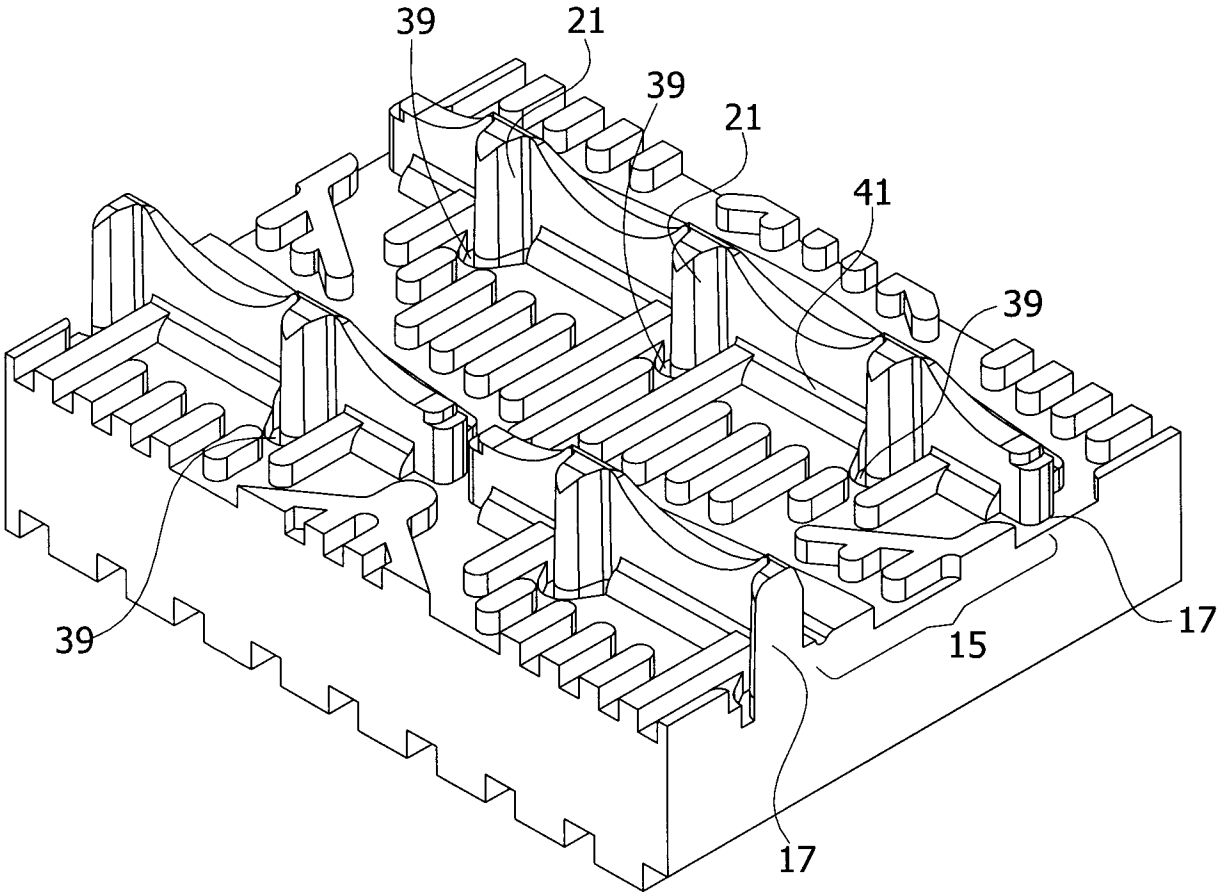
FIG. 5 is a "low angle shot" perspective view of a section of the panel of FIG. 2A.

Referring to FIG. 5, an enlarged section of the panel 11 is shown from a bottom view perspective. In this embodiment of the panel 11, grooves 39 are provided at the junction of the tabs 21 and the bottom surface 27 of the channels 15. These grooves 39 provide additional flexibility or increased flexural movement of the tabs 21 at the time of positioning a brick underneath the ribs 17 of a channel 15. In addition, stoppers or reinforcing elongated strips 41 extend underneath each of the ribs at a junction between said rib and a bottom surface of the channel. These elongated strips 41 have the shape of raised elongated joints formed underneath the ribs 17, These stoppers or elongated strips 41 ensure that the bricks 3 do not damage the panel 11 at the time of insertion, by biting into it to deeply, in cases where the panel 11 is made of polystyrene for example. The stoppers or elongated strips 41 also help ensuring that all the bricks 3 will rest at the same distance on the bottom of the channels 15. Finally, the stoppers or elongated strips 41 may also act as reinforcing elements for the ribs 17.

Figure 6:
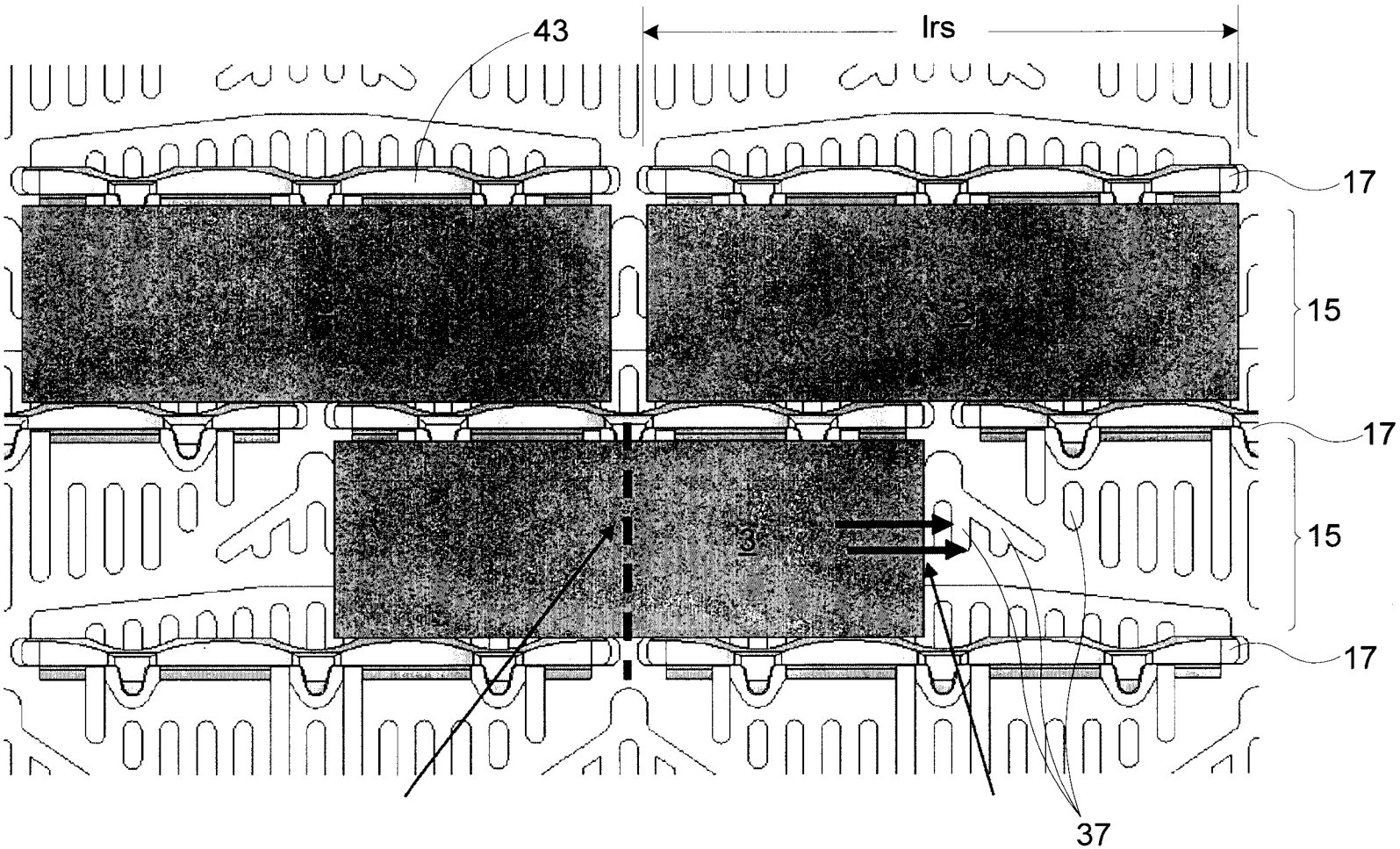
FIG. 6 is a front view of the masonry panel of FIG. 2A, with three bricks inserted into the panel.

Referring to FIG. 6, three bricks 3 are shown in place in the panel 11. As illustrated, the length $l_{rs}$ of the upper protruding rib segments 43 of a channel 15 can be determined so as to correspond to the length $l_b$ of the bricks 3, these sections 43 thereby acting as guides for positioning the bricks 3 in place in the channels 15. In addition, the width of the protuberances 37 and the spacing between these protuberances 37 can be determined so as to be used for more finely positioning a brick 3 in a channel 15. This characteristic is especially useful in applications where clay bricks are used, since variations in the overall dimensions of the bricks are common within lots of the same "predetermined" brick size, such as 12" bricks for example. In this preferred embodiment, the width of the protuberances and the distance between two protuberances is equal to 0.25 inch, but of course other dimensions can be chosen.

Figure 7A:
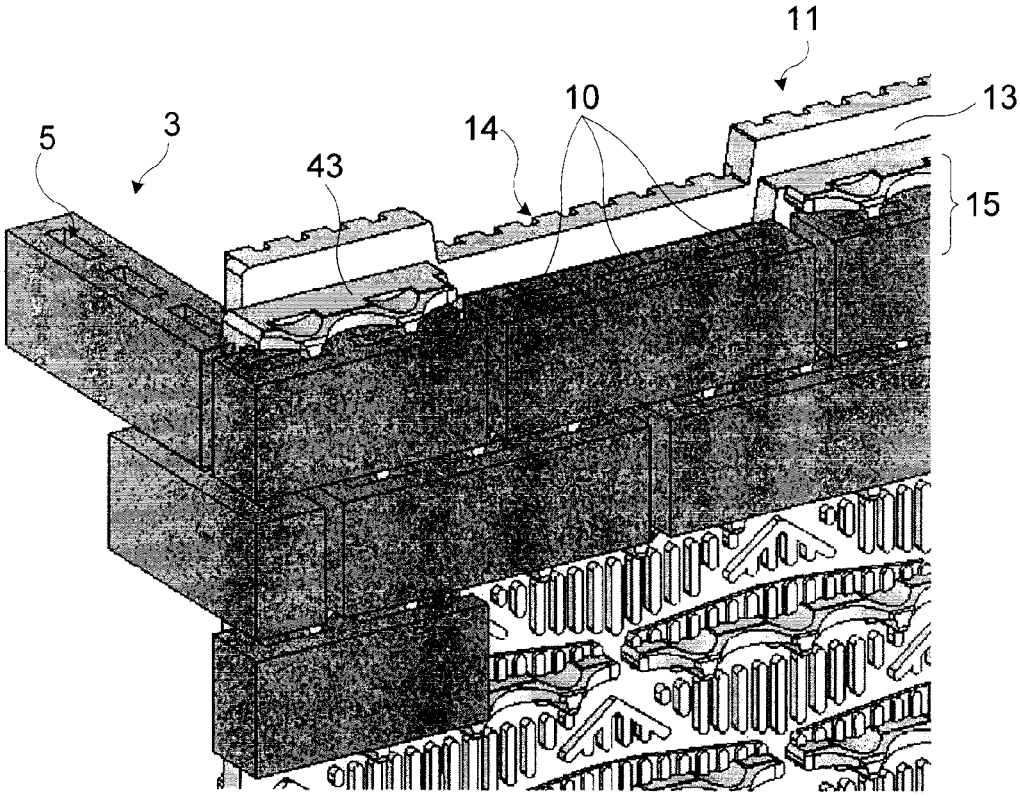
FIG. 7A is a partial perspective view of the panel of FIG. 2A, placed on a building wall, with bricks inserted within the channels of the panel.
Figure 7B:
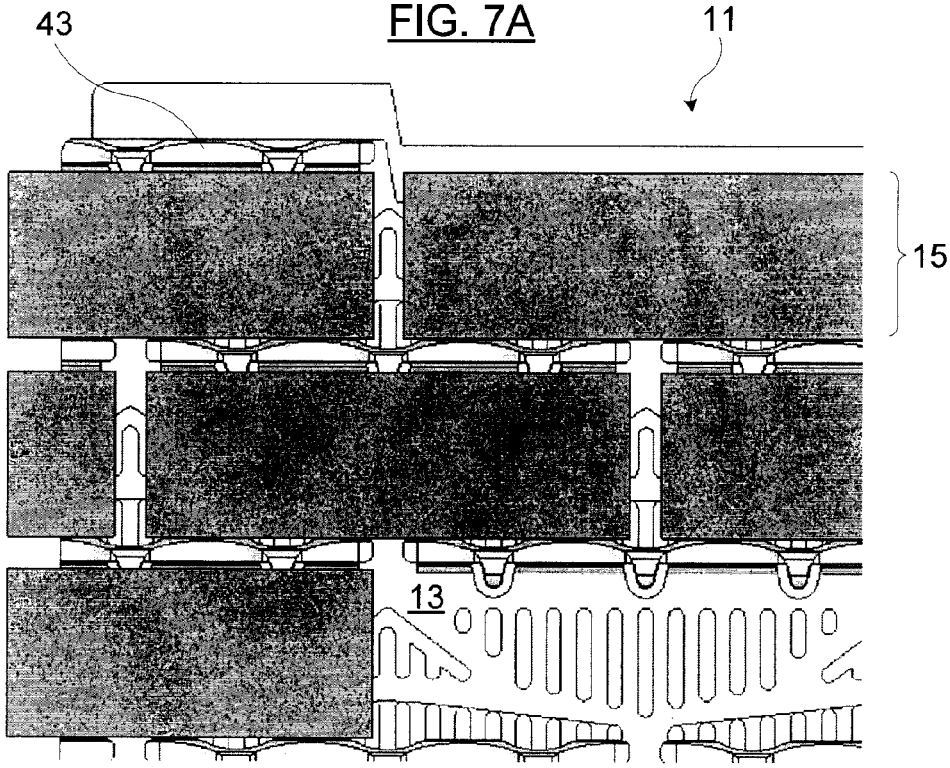
FIG. 7B is a partial front view of the panel of FIG. 7A.

Referring to FIGS. 7A and 7B, a panel 11 is shown with several bricks 3 in place on the panel 11. Panels 11 are mountable side by side on a building surface and securable to the building surface with wall-ties (not shown in the figures), the back face 14 of the panels 11 facing the building surface. The front face 13 of the panel 11 may also be provided with indicators (not shown in the figures) for indicating where the wall-ties can be positioned when securing the panels 11 to building surface. The horizontal and vertical edges of the panels are devised such that they can be fitted with the edges of a neighboring panel. Best shown in FIG. 7A, the top horizontal edge of the panel has a patterned contour that can fit with the contour of the bottom horizontal edge of a similar panel 11. The panel placed on top of the panel shown would be provided with a similar complementary pattern and include protruding rib segments 43 so as to complete the upper rib 17 of the upper most channel 15 illustrated. Panels 11 placed on the corner of a building can be cut at a 45 degree angle and be fitted with edges of other panels 11 to eventually cover the building's wall completely.

Preferably, the combined thickness of the panel and the bricks inserted in the panel is between 3 and 4 inches (or between 7.6 and 10.2 cm). That is, if the thickness of the panel is equal to 2 inches (5.08 cm), the thickness $t_b$ of the brick will vary between 1 and 2 inches (or 2.54 and 5.08 cm). Of course, in other embodiments, the panel can be used with conventional clay bricks having a thickness varying between 3 and 4 inches.

Figure 8:
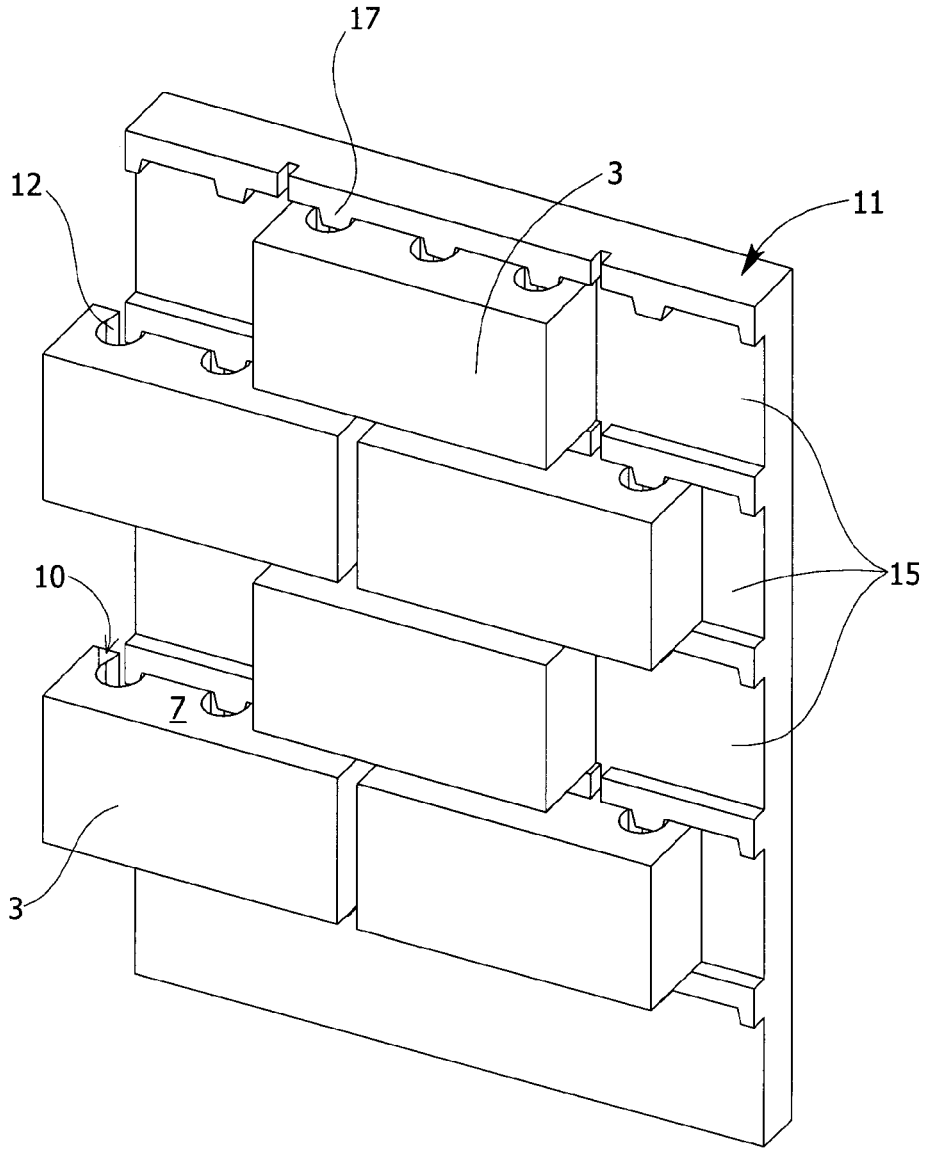
FIG. 8 is a perspective view of a masonry wall system according to another embodiment of the invention, showing several bricks positioned in a panel.
Figure 9:
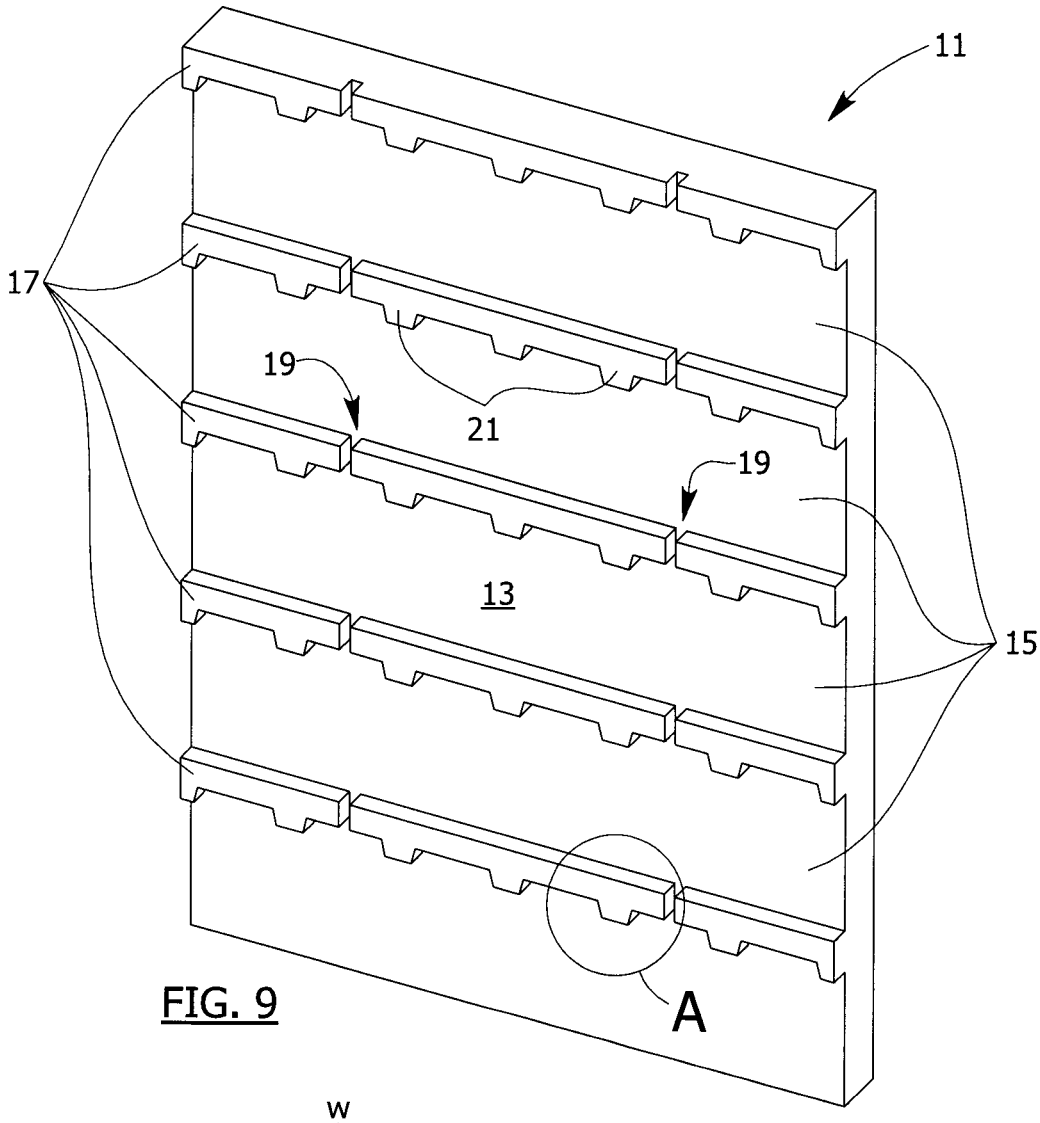
FIG. 9 is a perspective view of the masonry wall panel shown in FIG. 8.
Figure 9A:
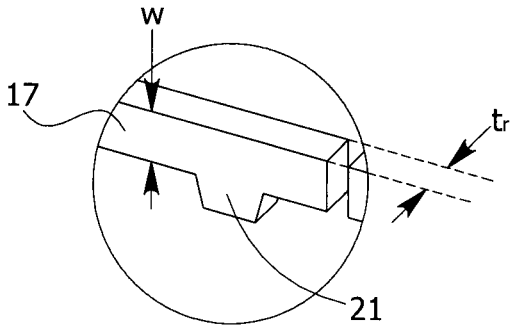
FIG. 9*a* is an enlarged view of section A of FIG. 9.

Now referring to FIGS. 8 and 9, there is shown yet another embodiment of the invention. FIG. 8 shows a panel 11 in which a plurality of bricks 3 have been inserted. The panel 11 has a front face 13 provided with a plurality of horizontally extending channels 15 delimited by protruding ribs 17. The ribs 17 are for receiving rows of bricks 3 in the channels. Preferably, the channels 15 are pre-cut in the panel, or pre-moulded as the panel is being moulded. Best shown in enlarged FIG. 9*a*, the ribs 17 have a predetermined width w and a predetermined thickness $t_r$ smaller that the thickness $t_b$ of the bricks 3 so as to leave a surface on the upper side 7 of the bricks 3 to receive the mortar or any other bonding material used in masonry.

These panels 11 are preferably made of polystyrene or any other material known in the art and which are commonly used in this field. Of course, other materials offering similar compressible characteristics can be used.

Referring to FIG. 9, the tabs 21 are made of compressible or deformable material. As illustrated, the tabs 21 are shaped as a trapezoidal tooth and positioned along the ribs 17. Of course, the tabs 21 may have other shapes, such as a cubic shape for example. Each one of the channels 15 is delimited by an upper rib and a lower rib. The tabs 21 are arranged along the upper ribs 17 and are facing towards the channels 15.

In this preferred embodiment, apertures or gaps 19 are practiced in the protruding ribs 17, forming rib segments 43, to allow the flow of water that may have seeped to the front face 13 of the panel 5 down the panel to a catch room (not shown in the figures). In use, that is, when bricks 3 are inserted into the channels of the panel, the front portions of the tabs 21 protrude into the respective cavities 5 of the corresponding bricks 3 while the back portions of the tabs 21 compress the compression areas 10 of the bricks 3, thereby retaining the bricks within the panel.

In another preferred embodiment of the present invention, a kit for building a masonry wall panel assembly is provided. This kit and referring to FIGS. 1A to 9, comprises a set of panels and a set of bricks as described above.

In accordance with another aspect of the invention, there is provided a method for installing a masonry wall panel assembly including components as described above.

In accordance with this method, and referring to FIGS. 1A to 9, a first step consists of mounting side by side onto a building surface a plurality of panels 11. Once a first panel 11 is secured, other panels 11 are fitted at their edges with the previous panel 11 installed and are secured as described above. This step is repeated until the wall surface is completely covered with panels 11. The panels 11 can advantageously be cut when they are installed around doors and windows or when they are installed near the edges of the building surface to cover.

Bricks 3 are then positioned into each of the channels 15 of the panels 11, forming rows of side by side masonry bricks 3. Each of the masonry bricks 3 is aligned with a corresponding section 43 of the upper protruding rib 17 of a given channel 15, so that the cavities 5 of the bricks are placed on top and so that they are in line with the tabs 21 of the corresponding rib segment 43. The brick 3 is then inserted into the channel 15 by placing the bottom edge of the rear surface 9 of the brick 3 into the channel 15 and resting against the bottom rib 17 bounding the channel 15. The brick 3 is then pivoted on this bottom edge inwardly towards the inside of the channel 15. By doing so, compression area 10 of the brick 3 will compress the back portion 25 of the corresponding retaining tab 21, and the front portion 23 of the tab 21 will expand and protrude into the cavity 5 of the brick 3, the tab 21 thereby securing the brick 3 within the channel 15 of the panel 11. These steps are repeated for each brick, until the channels 15 of the panel 11 are filled with bricks 3. Of course, only one or a few rows of bricks could be filled within a panel.

Once the panel is completely filled with bricks 3, mortar material is inserted in between adjacent masonry bricks 3 to bind the bricks 3 together.

Of course, numerous modifications could be made to the embodiments above without departing from the scope of the present invention.

What is being a claimed:

1. A masonry wall panel assembly comprising:

a panel having:

a front face having a plurality of horizontally extending contiguous channels wherein:

each channel is bounded by respective upper and lower protruding ribs for fitting a row of bricks in the channel, a plurality of compressible retaining tabs positioned along the upper rib of each channel for retaining bricks inserted in the channels wherein:

each tab projects from underneath the upper rib and extends frontward; and each tab has a front portion and a back portion;

wherein the upper and lower ribs have a given thickness and the tabs extend the entire thickness of the upper rib they are projecting from and the thickness of the upper ribs decreases between the tabs;

a plurality of bricks insertable within the channels, wherein each brick comprises:

an upper side facing upward when the brick is inserted in one of the channels;

an under side facing downward when the brick is inserted in one of the channels;

a rear side facing the panel when the brick is inserted in one of the channels;

a rear top edge intersecting the upper side and the rear side;

at least one cavity on the upper side, wherein said at least one cavity opens out onto the rear side via an opened passage extending to the rear side or is closed;

at least one compression area located on the upper side, in between the at least one cavity and the rear top edge;

wherein in use, when one of said bricks is inserted into a channel of the panel, the brick is positioned such that at least one of said cavity on the upper side faces one or more tabs on the upper rib of the channel, such that the front portion of said one or more tab protrudes into a corresponding one of said cavity while the back portion compresses the compression area of the brick, thereby retaining the brick within the channel.

2. A masonry wall panel assembly of claim 1, wherein the tabs have a tapering transverse cross-section.

3. A masonry wall panel assembly of claim 1, wherein grooves are provided at the junction of the tabs and a bottom surface of the channels to provide additional flexibility to the tabs at the time of positioning a brick underneath the rib.

4. A masonry wall panel assembly of claim 1, wherein the upper ribs have a top surface provided with concave deformations, each one of said concave deformations being opposite to one of said tabs to provide additional flexibility to the tabs at the time of positioning a brick underneath the rib.

5. A masonry wall panel assembly of claim 1, wherein the ribs consist of a plurality of aligned rib segments interrupted by gaps for allowing water drainage.

6. A masonry wall panel assembly of claim 5, wherein the rib segments have a length (L), and act as guides for positioning bricks having a length (Lb) equals to the length (L) of the rib segments.

7. A masonry wall panel assembly of claim 5, wherein said channels have a bottom surface provided with drainage ribs for guiding water seeping through the assembly.

8. A masonry wall panel assembly of claim 7, wherein the drainage ribs comprises a plurality of inverted-V shaped ribs, each having a pointed end located under one of said gaps.

9. A masonry wall panel assembly of claim 8, wherein the drainage ribs further comprise arched ribs, each extending above one of said rib segments and under one of said inverted V-shaped ribs to receive water flowing out from the inverted V-shaped rib and direct it towards the gaps bordering the rib segment.

10. A masonry wall panel assembly of claim 9, wherein the drainage ribs further comprise vertical ribs located between the inverted V-shaped ribs and within the V portion of the inverted V-shaped ribs.

11. A masonry wall panel assembly of claim 10, wherein the vertical ribs has a width and spacing between each two adjacent vertical ribs predetermined so as to guide the installation of the bricks within the channels.

12. A masonry wall panel assembly of claim 9 located under said arched ribs.

13. A masonry wall panel assembly of claim 12, wherein the recesses have an oblong shape.

14. A masonry wall panel assembly of claim 1, comprising a reinforcing elongated strip extending underneath each of said ribs at a junction between said rib and a bottom surface of the channel.

15. A masonry wall panel assembly of claim 1, wherein said at least one cavity of said bricks is a through hole extending from the upper side to the under side of the brick.

16. A masonry wall panel assembly of claim 1, wherein said at least one cavity of said bricks opens out onto the rear side via an opened passage extending to the rear side and wherein the bricks comprise additional compression areas that extend on an inner lateral wall of said at least one cavity.

17. A masonry wall panel assembly of claim 1, wherein said at least one cavity of said bricks is a recess on the upper side of the brick.

18. A kit for building a masonry wall panel assembly, comprising:

a set of panels, each panel having:

a front face having a plurality of horizontally extending contiguous channels wherein:

each channel is bounded by respective upper and lower protruding ribs for fitting a row of bricks in the channel, a plurality of compressible retaining tabs positioned along the upper rib of each channel for retaining bricks inserted in the channels wherein:

each tab projects from underneath the upper rib and extends frontward; and each tab has a front portion and a back portion;

wherein the upper and lower ribs have a given thickness and the tabs extend the entire thickness of the upper rib they are projecting from and the thickness of the upper ribs decreases between the tabs;

a set of bricks insertable within the channels, wherein each brick comprises:

an upper side facing upward when the brick is inserted in one of the channels;

an under side facing downward when the brick is inserted in one of the channels;

a rear side facing the panel when the brick is inserted in one of the channels;

a rear top edge intersecting the upper side and the rear side;

at least one cavity on the upper side, wherein said at least one cavity opens out onto the rear side via an opened passage extending to the rear side or is closed;

at least one compression area located on the upper side, in between the at least one cavity and the rear top edge;

wherein in use, when one of said bricks is inserted into a channel of the panel, the brick is positioned such that at least one of said cavity on the upper side faces one or more tabs on the upper rib of the channel, such that the front portion of said one or more tab protrudes into a corresponding one of said cavity while the back portion compresses the compression area of the brick, thereby retaining the brick within the channel.

19. A method for installing a masonry wall panel assembly comprising:

providing a set of panels, each panel having:

a front face having a plurality of horizontally extending contiguous channels wherein:

each channel is bounded by respective upper and lower protruding ribs for fitting a row of bricks in the channel, a plurality of compressible retaining tabs positioned along the upper rib of each channel for retaining bricks inserted in the channels wherein:

each tab projects from underneath the upper rib and extends frontward; and each tab has a front portion and a back portion;

wherein the upper and lower ribs have a given thickness and the tabs extend the entire thickness of the upper rib they are projecting from and the thickness of the upper ribs decreases between the tabs;

providing a set of bricks, each brick comprising:

an upper side;

an under side;

a rear side;

a rear top edge intersecting the upper side and the rear side;

at least one cavity on the upper side, wherein said at least one cavity opens out onto the rear side via an opened passage extending to the rear side or is closed;

at least one compression area located on the upper side, in between the at least one cavity and the rear top edge;

inserting the bricks into each channel of the panels, thus forming rows of masonry bricks, comprising for each bricks the steps of:

positioning the brick such that at least one of said cavity on the upper side faces one or more tabs on the upper rib of the channel and such that the front portion of said one or more tab protrudes into a corresponding one of said cavity;

pivoting a lower part of the brick toward the panel until the under side rest on the lower rib thereby causing a compression between the compression area of the brick and the back portion of said one or more tabs; and inserting mortar material in between adjacent masonry bricks to bind the bricks together.

* * * * *